US009502815B2

(12) United States Patent
Akiguchi et al.

(10) Patent No.: US 9,502,815 B2
(45) Date of Patent: Nov. 22, 2016

(54) ELECTRICAL CONNECTOR

(71) Applicants: Tyco Electronics Japan G.K., Kanagawa-ken (JP); Toyota Jidosha Kabushiki Kaisha, Aichi-ken (JP)

(72) Inventors: Tetsuro Akiguchi, Kanagawa-ken (JP); Kazuhiko Ueda, Aichi-ken (JP); Natsuki Nozawa, Aichi-ken (JP); Hitoshi Ozaki, Aichi-ken (JP); Masao Noguchi, Aichi-ken (JP); Arata Harada, Aichi-ken (JP)

(73) Assignees: Tyco Electronics Japan G.K., Kanagawa-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/613,461

(22) Filed: Feb. 4, 2015

(65) Prior Publication Data

US 2015/0222046 A1 Aug. 6, 2015

(30) Foreign Application Priority Data

Feb. 4, 2014 (JP) ..... 2014-019322

(51) Int. Cl.

| | |
|---|---|
| ***H01R 13/648*** | (2006.01) |
| ***H01R 13/533*** | (2006.01) |
| ***H01R 12/91*** | (2011.01) |
| ***H01R 13/502*** | (2006.01) |

(Continued)

(52) U.S. Cl.

CPC ..... *H01R 13/533* (2013.01); *H01R 12/91* (2013.01); *H01R 13/10* (2013.01); *H01R 13/502* (2013.01); *H01R 12/716* (2013.01); *H01R 13/114* (2013.01)

(58) Field of Classification Search

CPC ..... H01R 13/533; H01R 33/975; H01R 13/6315

USPC ..... 439/382–385

See application file for complete search history.

(56) References Cited

U.S. PATENT DOCUMENTS

| | | | |
|---|---|---|---|
| 4,738,631 | A | 4/1988 | Takahashi et al. |
| 5,380,222 | A | 1/1995 | Kobayashi |

(Continued)

FOREIGN PATENT DOCUMENTS

| | | | |
|---|---|---|---|
| JP | 57158969 | A | 9/1982 |
| JP | 725584 | U | 5/1995 |

(Continued)

OTHER PUBLICATIONS

European Search Report, Application No. 15153025.0-1801, dated Jun. 25, 2015, 6 pages.

Japanese Office Action, dated Jun. 3, 2015, 3 pages.

*Primary Examiner* — Xuong Chung Trans

(74) *Attorney, Agent, or Firm* — Barley Snyder

(57) ABSTRACT

An electrical connector is disclosed having a terminal housing and a female type terminal positioned in the terminal housing. The terminal housing has a first terminal housing, and a second terminal housing positioned independent from the first terminal housing. The female type terminal has a first female terminal, second female terminal, and a coupling member. The first female terminal is positioned in the first terminal housing and is electrically connected to a first male terminal. The second female terminal is positioned in the second terminal housing and is electrically connected to a second male terminal. The coupling member connects the first female terminal to the second female terminal.

16 Claims, 7 Drawing Sheets

(51) Int. Cl.

| | |
|---|---|
| ***H01R 13/10*** | (2006.01) |
| *H01R 12/71* | (2011.01) |
| *H01R 13/11* | (2006.01) |

(56) References Cited

U.S. PATENT DOCUMENTS

| | | | | |
|---|---|---|---|---|
| 5,883,561 | A * | 3/1999 | Nakamura | H01H 85/0417 337/159 |
| 6,315,591 | B2 * | 11/2001 | Oda | 439/246 |

FOREIGN PATENT DOCUMENTS

| | | | |
|---|---|---|---|
| JP | 2000-91029 | A | 3/2000 |
| JP | 2003151677 | A | 5/2003 |
| JP | 2003-323924 | A | 11/2003 |
| JP | 2006228451 | A | 8/2006 |
| JP | 201410949 | A | 1/2014 |
| WO | 2014002389 | A1 | 3/2014 |
| WO | 2014002408 | A1 | 3/2014 |

* cited by examiner

ELECTRICAL CONNECTOR

CROSS-REFERENCE TO RELATED APPLICATION

This application claims priority under 35 U.S.C. §119(a)-(d) to Japanese Patent Application No. 2014-019322, dated Feb. 4, 2014.

FIELD OF THE INVENTION

The invention is generally related to an electrical connector, and more specifically, to a vibrationally stable electrical connector.

BACKGROUND

Electrical connectors ("connector") are used in a variety of applications, and depending on the application, the connectors may be subjected to strong vibrational forces. A conventional connector generally includes a male connector having male type terminals and a female connector having female type terminals, which in turn are electrically connected to the male type terminals when mated with each other. However, when the connectors are subjected to vibration, initial connecting conditions between points of contacts of the male type terminals and the female type terminals cannot always be maintained, reducing the connecting reliability of connectors.

Japanese Patent Application Nos. 2000-91029A and 2003-323924A disclose examples of conventional connectors having vibration resistant properties. JP 2000-91029A discloses a conventional connector in which a male connector is connected to a female connector, even if the male connector and the female connector are not accurately facing each other. Further, this conventional connector can prevent deformation or damage in the event of a positional shift or vibration being generated between modules, after connecting both connectors.

JP 2003-323924A discloses another conventional connector where only a small percentage of a vibration or shock is transmitted between connectors, such that reliable connecting conditions can be maintained, while allowing for the physical size of the connector to be reduced.

In conventional connectors, where a plurality of female type terminals are positioned in a common housing and a plurality of male type terminals are connected thereto, the male type terminals are often fixed to a single device, such as a circuit board. When this circuit board vibrates due to external factors, both the male type terminals and the female connector vibrate in sync with the circuit board. Accordingly, there is a relative positional relationship, such that a connection relation between the male type terminals and the female type terminals will maintain the initial condition, or even if it cannot be maintained, the relative displacement will be minute.

However, there are also situations in the male type terminals are fixed to different devices. For example, as shown in FIG. 7, first male type terminals $M_A$ are connected to a first circuit board $S_A$ and second male type terminals $M_B$ are connected to a second circuit board $S_B$, and are respectively connected to two female type terminals $F_A$, $F_B$ held in a common housing. The respective vibration modes of the first circuit board $S_A$ and the second circuit board $S_B$ may have different durations of vibration and amplitudes. Displacement of the first male type terminals $M_A$ accompanying the vibration, and the displacement of the second male type terminals $M_B$ accompanying the vibration will differ. The relative positional relationship must be maintained between the first male type terminals $M_A$ and the first female type terminals $F_A$ as well as the relative positional relationship between the second male type terminals $M_B$ and the second female type terminals $F_B$. For example, when the common housing holding the female type terminals $F_A$, $F_B$ is fixed to the first circuit board $S_A$, the second male type terminals $M_B$ might be shifted in position with respect to the housing by the vibrational force. When the second male type terminals $M_B$ extend through male terminal receiving passageways disposed in the housing, and are connected to the second female type terminals $F_B$, the second male type terminals $M_B$ will be displaced with the housing within the receiving passageways. Since surfaces of the second male type terminals $M_B$ are usually formed with a plating film for maintaining favorable electric connection, there is a risk that the plating film is peeled through this sliding, and debris is scattered to the periphery. Since the debris is made of metal and exhibits conductivity, they might become factors causing inconveniences such as short-circuiting of peripheral electronic circuits.

As such, there is a need for an electrical connector that reduces sliding between male type terminals fixed to a circuit board or other device, and a housing upon being subject to different vibrational mode.

SUMMARY

An electrical connector has a terminal housing and a female type terminal positioned in the terminal housing. The terminal housing has a first terminal housing, and a second terminal housing positioned independent from the first terminal housing. The female type terminal has a first female terminal, second female terminal, and a coupling member. The first female terminal is positioned in the first terminal housing and is electrically connected to a first male terminal. The second female terminal is positioned in the second terminal housing and is electrically connected to a second male terminal. The coupling member connects the first female terminal to the second female terminal.

BRIEF DESCRIPTION OF THE DRAWINGS

The drawings will now be described by way of example, with reference to the accompanying Figures, of which.

DETAILED DESCRIPTION OF THE EMBODIMENT(S)

The present invention will now be described with reference to FIGS. 1-6.

Figure 1:
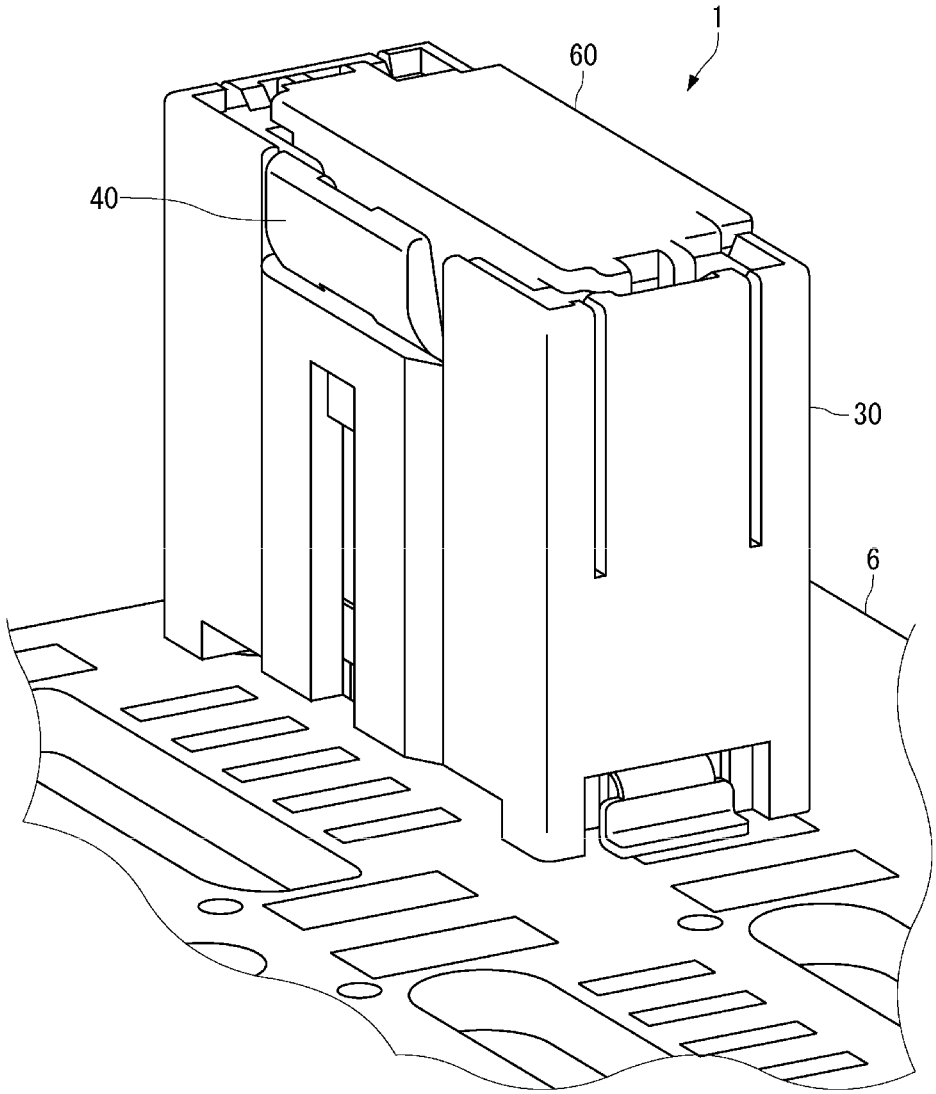
FIG. 1 is a perspective view of an electrical connector.
Figure 2:
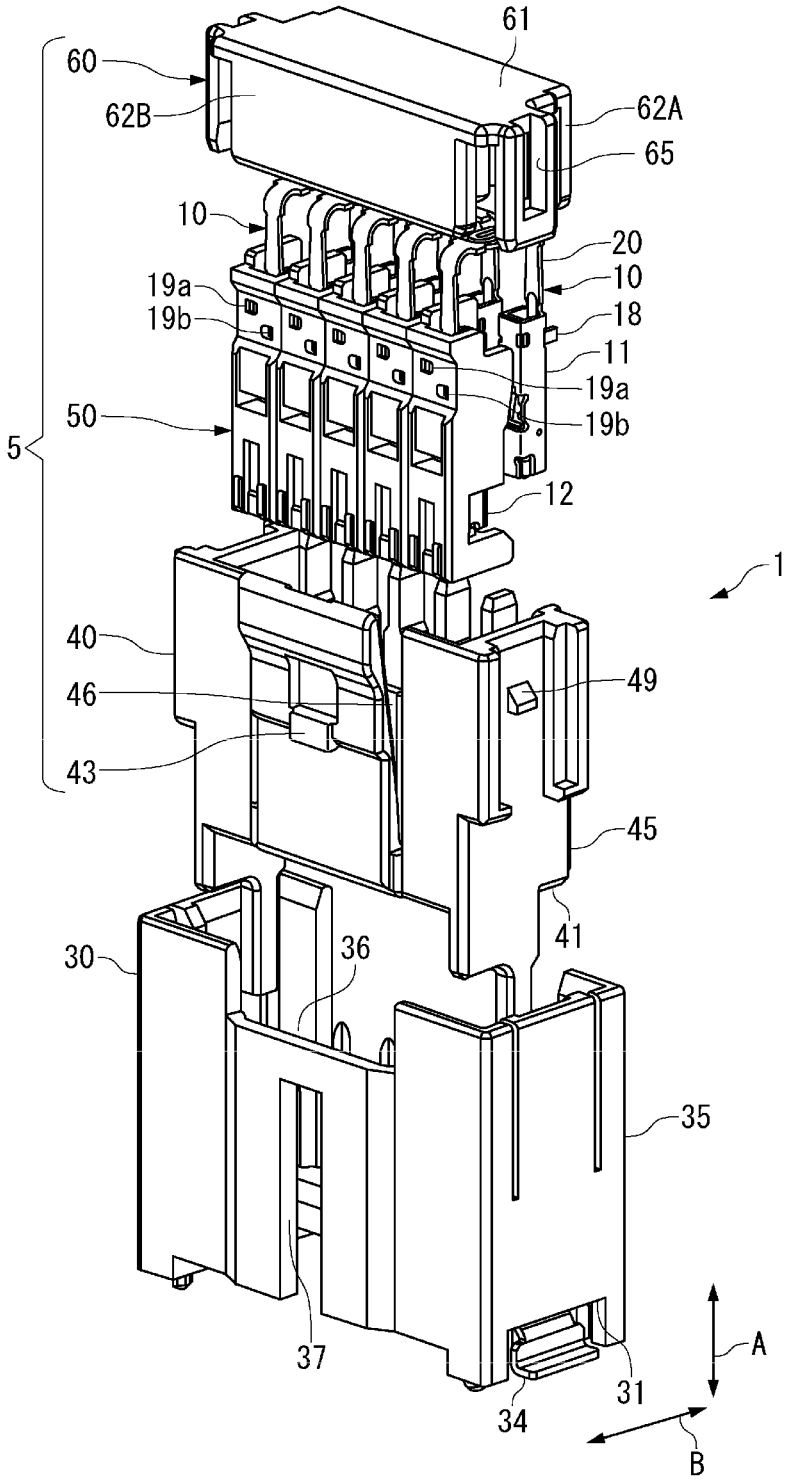
FIG. 2 is an exploded perspective view of the electrical connector of FIG. 1.
Figure 3:
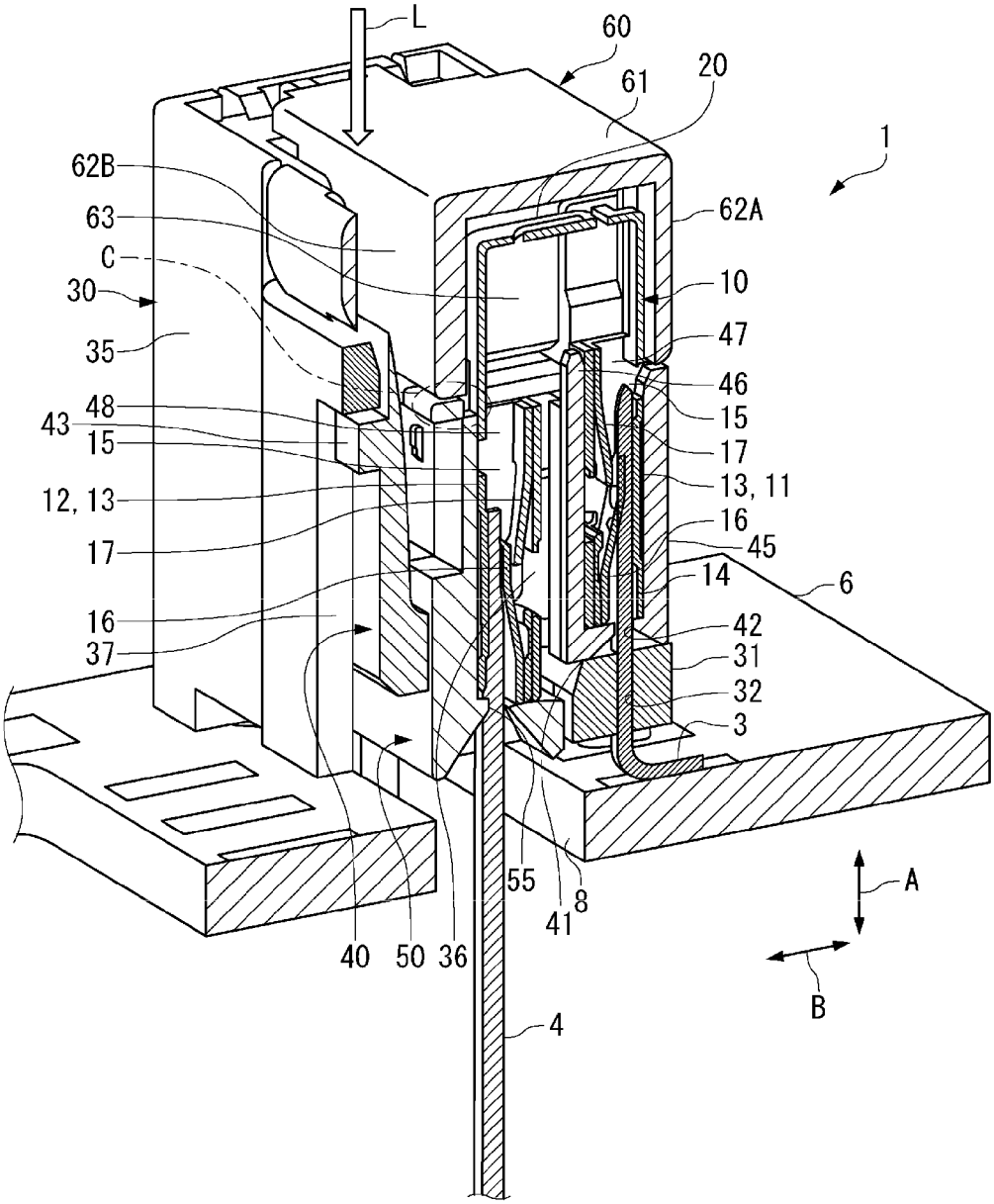
FIG. 3 is a longitudinal sectional view of the electrical connector of FIG. 1.

In the embodiments of FIGS. 2 and 3, an electrical connector 1 has a female housing assembly 5 into what a plurality of female type terminals 10 are positioned and a shell 30 for holding first male type terminals 3. A first male type terminal 3 and a second male type terminal 4 are electrically connected to one female type terminal 10, and the female housing assembly 5 is fixed to the shell 30. Each female type terminal 10 to corresponds to one first male type terminals 3 and one second male type terminals 4. The first male type terminals 3 are electrically connected and fixed to a circuit board 6, while the second male type terminals 4 are electrically connected and fixed to an electronic device (not shown) positioned downward of the circuit board 6 in the drawing. In this manner, since the first male type terminals 3 and the second male type terminals 4 are respectively fixed to different objects, each terminal 3,4 may exhibit vibration modes differing from the other. In the electrical connector 1, the female housing assembly 5 supports the female type terminals 10 with a configuration that absorbs these different vibration modes.

Figure 4:
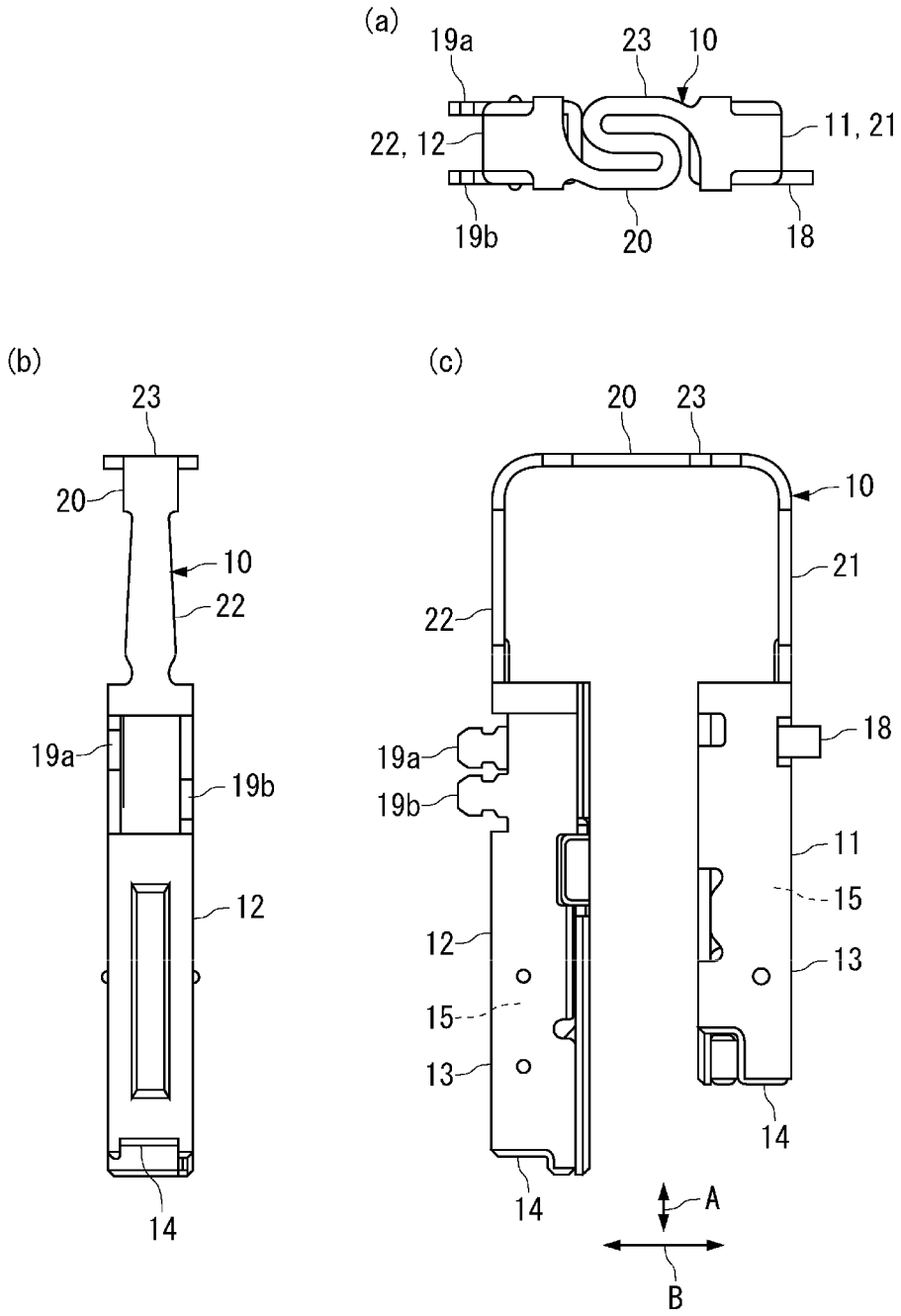
FIGS. 4(*a*)-(*c*) are perspective views of three faces of a female type terminal.

In an embodiment of FIG. 4, the female type terminal 10 includes a first female terminal 11, a second female terminal 12, and a coupling spring 20 connecting the first female terminal 11 and the second female terminal 12. The first female terminal 11 and the second female terminal 12 are positioned in parallel, and the first male type terminal 3 and the second male type terminal 4 are respectively inserted into the female terminals 11,12 from the same direction.

In the female type terminal 10, the first female terminal 11, the second female terminal 12, and the coupling spring 20 are integrally formed by cutting and bending a metallic plate of high conductivity, such as copper or copper alloy.

While the first female terminal 11 and the second female terminal 12 are manufactured to be of the same specification, positions at which each of them are connected to the first male type terminal 3 and the second male type terminal 4 differ in the insertion and extraction directions A (See FIGS. 2 and 3) with respect to the first male type terminal 3 and the second male type terminal 4. In the female type terminal 10, the first female terminal 11 and the second female terminal 12 can displace independently with respect to each other upon being subject to different vibrational forces.

In the embodiments of FIGS. 3 and 4, the first female terminal 11 includes a box-shaped terminal body 13 having a male terminal receiving opening 14 into which the first male type terminal 3 is inserted and being positioned on a mating end thereof, and a male terminal receiving space 15 for receiving the first male type terminal 3 inserted through the male terminal receiving opening 14. The coupling spring 20 is integrally connected to an opposing connecting end of the terminal body 13. A primary contact 16 and a supporting contact 17 are positioned in the male terminal receiving space 15, and serve to press the inserted first male type terminal 3 against an inner wall of the terminal body 13.

A positioning protrusion 18 (see FIG. 4) is formed on an outer wall of the terminal body 13. The positioning protrusion 18 holds the female type terminal 10 between a first terminal housing 40 and an upper housing 60 such that the female type terminal 10 is positioned in a first terminal receiving space 47 of the first terminal housing 40.

Since the second female terminal 12 is of identical specification as the first female terminal 11, only points of difference will be explained herein below. In this respect, components which are substantially or completely identical to those of the first female terminal 11, are marked with the same reference numerals in the Figures.

As described above, the first female terminal 11 and the second female terminal 12 are positioned such that connection portions with the first male type terminal 3 and the second male type terminal 4 may be displaced in the insertion and extraction directions A. In an embodiment of FIG. 3, the second male type terminal 4 contacts the primary contact 16 of the second female terminal 12 at a position closer to the circuit board 6 than that of the first female terminal 11.

In an embodiment of FIG. 4, the coupling spring 20 connecting the first female terminal 11 and the second female terminal 12 includes a first and second connecting arm 21, 22 and a connecting beam 23 extending substantially perpendicular to the connecting arms 21,22, and connecting complimentary ends of the connecting arms 21,22. The coupling spring 20 is formed to elastically deform at force which is weaker than a force which the first male type terminal 3 and the second male type terminal 4 are inserted and extracted with respect to the first female terminal 11 and the second female terminal 12. Therefore, the first female terminal 11 and the second female terminal 12 can independently displace when the electrical connector 1 is subjected to vibration.

The first connecting arm 21 is integrally connected to the connecting end of the first female terminal 11, and extends in the insertion and extraction directions A. Similarly, the second connecting arm 22 is integrally connected to the connecting end of the second female terminal 12, and extends in the insertion and extraction directions A. The connecting arms 21, 22 are formed along the insertion and extraction directions A so that they mainly deflect in a width direction B orthogonal to the insertion and extraction directions A. The connecting arms 21, 22 narrow in width along a portion proximate to where the connecting arms 21,22 are connected to the first female terminal 11 and the second female terminal 12 (see FIG. 4(*b*)), such that the connecting arms 21,22 easily deflect upon receiving an applied vibrational force.

The connecting beam 23 has an approximate S-shape to reduce its spring constant. The connecting beam 23 thus easily deflects in the inserting and extracting directions A. The female type terminal 10 is independently connected to the terminal housing assembly 5, the first female terminal 11 is independently engaged with the first terminal housing 40 and the upper housing 60. The connecting beam 23 can accordingly be defined as a cantilever having a fixed end connected to the connecting arm 21, and a free end connected to the connecting arm 22.

In an embodiment of FIG. 3, a tab-type first male type terminal 3 is mated with the first female terminal 11. Further, a tab-type second male type terminal 4 is mated with the second female terminal 12. Respective surfaces of the first male type terminal 3 and the second male type terminal 4 are formed with a plating film for maintaining favorable electric connection with the first female terminal 11 and the second female terminal 12.

The first male type terminal 3, being for example, L-shaped, is connected to a front surface of the circuit board 6. The terminal 3 may connected, for example, through soldering (not shown) or other common terminal connection methods known to those of ordinary skill in the art. The second male type terminal 4 may be a linear pin-type terminal fixed to an electronic device (not shown). The electronic device is not in a mechanically coupled relationship with the circuit board 6. Accordingly, assuming that the electronic device and the circuit board 6 vibrate individually, the vibrational effects of the first male type terminal 3 and the second male type terminal 4 differ from each other since the vibration behaviors of the electronic device and the circuit board 6 differ from each other.

The first male type terminal 3 is electrically connected to the first female terminal 11 when inserted into the male terminal receiving space 15 of the first female terminal 11. The first male type terminal 3, which is pressed by the primary contact 16 and the supporting contact 17, both contacts 16,17 being elastically deformed through insertion of the first male type terminal 3, is pressed against an inner wall of the terminal body 13. With this positioning, the electric connection between the first female terminal 11 and the first male type terminal 3 is maintained.

The second male type terminal 4 is similarly connected electrically to the second female terminal 12 when inserted into the male terminal receiving space 15 of the second female terminal 12. The second male type terminal 4 is also pressed by the primary contact 16 and the supporting contact 17, thus the electric connection thereof to the second female terminal 12 is maintained. The circuit board 6 is formed with a terminal receiving groove 8 which extends through the front face to an opposite rear face of the circuit board 6. The second male type terminal 4 is inserted into the male terminal receiving space 15 by passing through the terminal receiving groove 8. In an embodiment, a first force F2 required for inserting and extracting the second male type terminal 4 and the second female terminal 12 is set to exceed a second force F1 required for the coupling spring 20 to elastically deform.

To assist in reliably maintaining electrical connection between the first male type terminal 3 and the first female terminal 11, a position at which the first female terminal 11 and the first male type terminal 3 are connected is maintained while the electronic connector 1 is in use. This is due to the possibility of a positional shift, where the electrical connection is lost due to lack of connection load due to wear of a connection surface between the first female terminal 11 and the first male type terminal 3. The same applies to the second male type terminal 4 and the second female terminal 12.

In an embodiment of FIG. 2, the female housing assembly 5 receives the female type terminals 10 therein.

In the embodiments of FIGS. 2 and 3, the female housing assembly 5 has three elements, namely the first terminal housing 40, the second terminal housing 50 and an upper housing 60. The first terminal housing 40, the second terminal housing 50 and the upper housing 60 are assembled from the circuit board 6 side in this order. The housing elements 40, 50, 60 are respectively manufactured by injection molding insulating resin.

In an embodiment of FIGS. 2 and 3, the shell 30 has a substantially cuboidal shape having an open receiving end, a shell base 31 positioned proximate to the front surface of the circuit board 6, and side walls 35 rising from a peripheral edge of the shell base 31. Collectively, the shell base 31 and the side walls 35 form an assembly receiving space 36 therein. The shell 30 holds the first male terminals 13

A first terminal receiving passageway 32 into which the first male type terminal 3 is inserted, is formed in the shell base 31. The opening dimension of the first terminal receiving passageway 32 is set such that the first male type terminal 3 is press-fit therein.

The shell base 31 is formed such that the thickness of a portion at which the first terminal receiving passageway 32 is formed, is thicker than a portion at which a second terminal receiving passageway 42 is formed, such that the first male type terminal 3 is retained by the shell base 31 with sufficient force.

The shell 30 includes a mounting foot 34 extending out of the interface of the shell base 31 and one sidewall 35 thereof for fixing to the front surface of the circuit board 6. By soldering the mounting foot 34 to the front surface of the circuit board 6, the shell 30 is fixed to the circuit board 6. In another embodiment, the mounting foot 34 is attached to the circuit board 6 using other common attachment mechanisms known to those of ordinary skill in the art.

The female type terminals 10, which are mated with both of the first male type terminals 3 and the second male type terminals 4, are positioned in the assembly receiving space 36. The first terminal housing 40 is positioned in the assembly receiving space 36, corresponding to, and holding the first female terminals 11. The second terminal housing 50, corresponding to, and holding the second female terminals 12. The first terminal housing 40 is connected to the shell 30.

In the embodiments of FIGS. 2 and 3, the first terminal housing 40 includes a first housing base 41, which opposes the shell base 31 when inserted into the assembly receiving space 36, side walls 45 extending from the periphery of the first housing base 41, and a first partitioning wall 46 for dividing a region surrounded by the first housing base 41 and the side walls 45 into a first terminal receiving space 47 and a second terminal housing receiving space 48.

The first housing base 41 is formed with a second terminal receiving space 42, through which the first male type terminal 3 is inserted. There is a clearance between an inner peripheral surface of the second terminal receiving space 42 and an outer peripheral surface of the first male type terminal 3. The same applies to a male terminal receiving opening 55 of the second terminal housing 50.

The first terminal receiving space 47 receives the first female terminal 11 and the second terminal housing receiving space 48 receives the second terminal housings 50 holding the second female terminals 12.

The first female terminals 11 are fixed and held to the first terminal housing 40 with a mating end, thereof at which the male terminal receiving opening 14 is formed, contacting the first housing base 41. The positioning protrusion 18 is positioned between the receiving end of the side walls 45 and the base end of the upper housing 60.

As shown in FIG. 3, the second terminal housings 50 hold the second female terminals 12 in the second terminal housing receiving space 48 of the first terminal housing 40. While the plurality of first female terminals 11 is held by the shell 30 collectively, each second terminal housing 50 corresponds to each of the plurality of second female terminals 12 and is attached thereto, as shown in FIGS. 2, 5, and 6.

Figure 5:
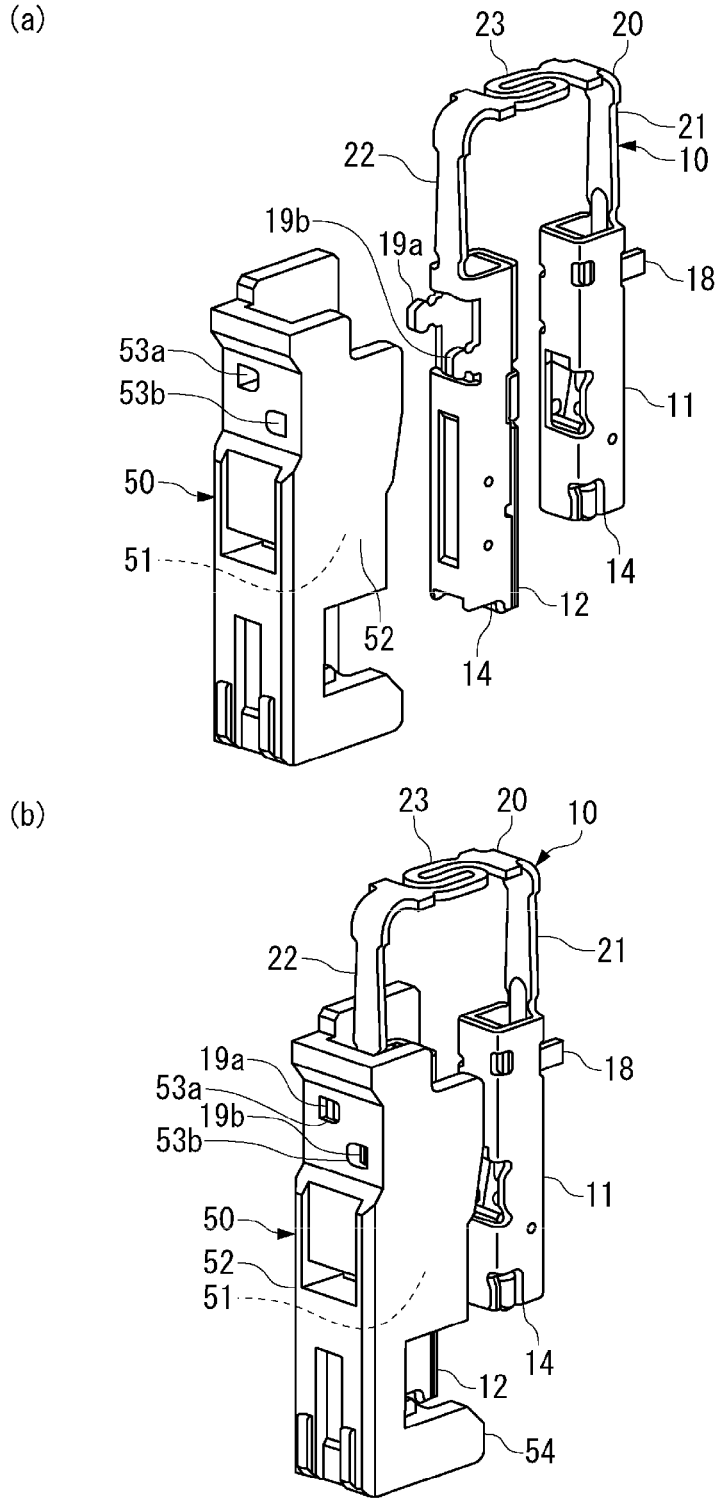
FIGS. 5(*a*) and 5(*b*) are perspective views of the female type terminal and a third housing, wherein both members are separated in FIG. 5(*a*) and both members are assembled in FIG. 5(*b*)
Figure 6:
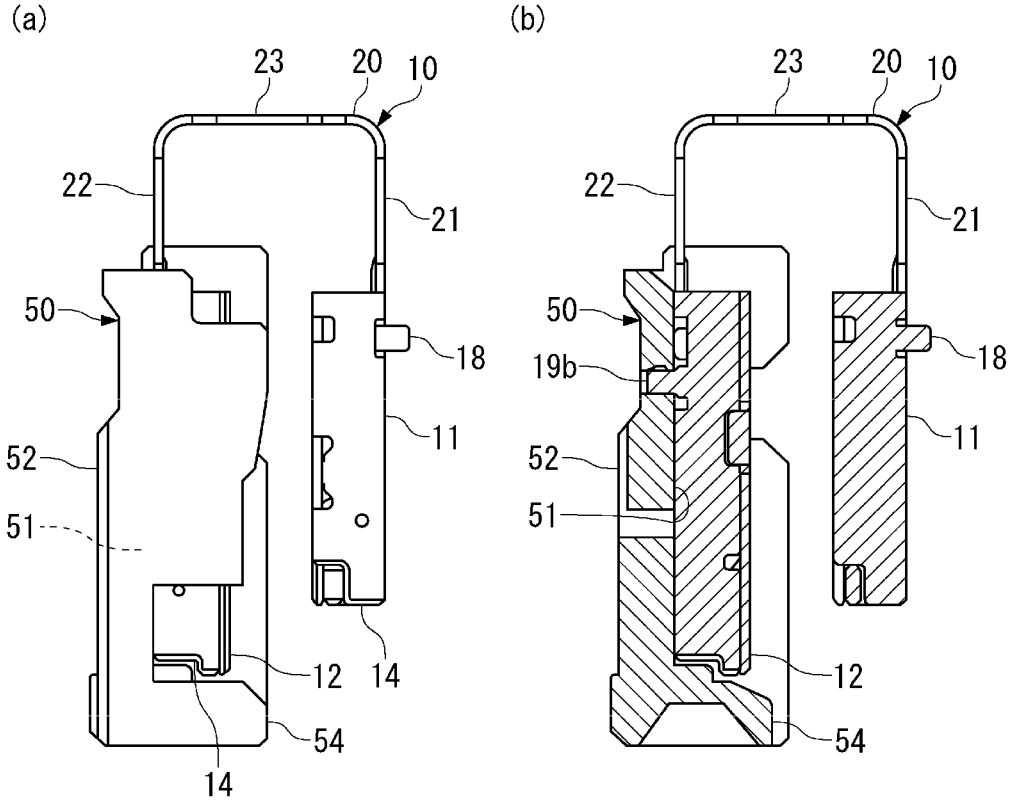
FIGS. 6(*a*) and 6(*b*) are views showing the female type terminal and the third housing of FIG. 5 assembled, wherein FIG. 6(*a*) is a front perspective view and FIG. 6(*b*) is a longitudinal sectional view.
Figure 7:
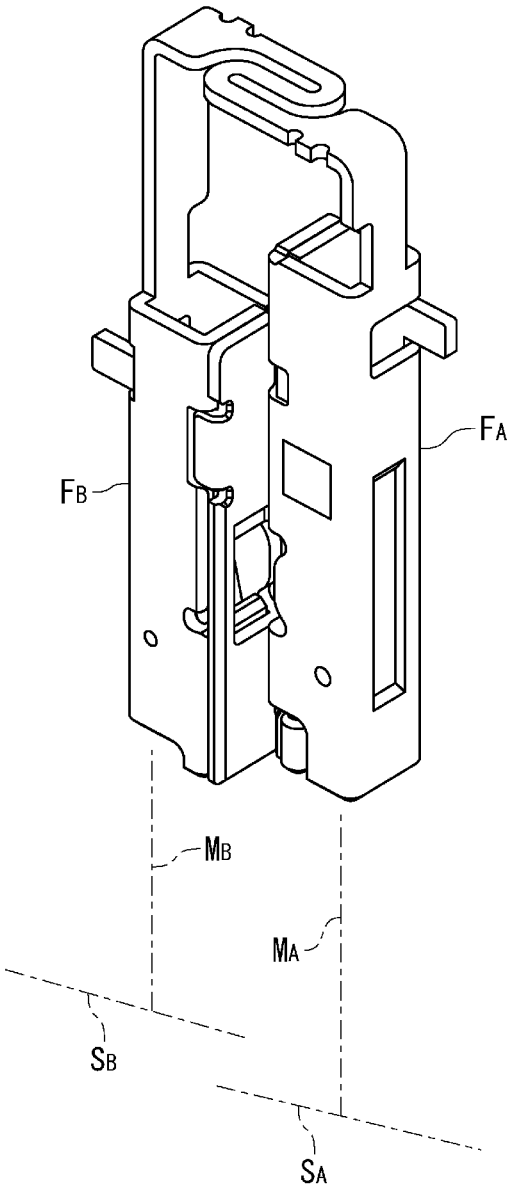
FIG. 7 is a perspective view of a female type terminal.

In the embodiments of FIGS. 5 and 6, each second terminal housing 50 includes a terminal receiving space 51 receiving and holding the second female terminal 12. The second terminal housing 50 includes a terminal housing base 54 and side walls 52 extending from a peripheral edge of the terminal housing base 54 to form a terminal receiving space 51. The terminal housing base 54 is positioned on a terminal receiving end of the second terminal housing 50. A female terminal receiving passageway (not labeled) is positioned in the terminal housing base 50, through which the second female terminal 12 is inserted.

Locking tab receiving spaces 53*a*, 53*b*, into which holding protrusions 19*a*, 19*b* of the second female terminal 12 are press-fitted, are formed in the side wall 52 and extend as through holes. The second female terminal 12 is held by the second terminal housing 50 with the holding protrusions 19*a*, 19*b* being press-fitted into the locking tab receiving spaces 53*a*, 53*b*.

The male terminal receiving openings 55, into which the second male type terminal 4 is inserted (see FIG. 3), are formed in the terminal housing base 54.

The mating end of the second female terminal 12, formed with the male terminal receiving opening 14, is positioned to oppose the terminal housing base 54. The holding protrusions 19*a*, 19*b* of the second female terminal 12 are inserted into the locking tab receiving spaces 53*a*, 53*b*, Accordingly, since the second female terminal 12 is mechanically integrated with the second terminal housing 50, the second terminal housing 50 vibrates integrally with the second female terminal 12.

In an embodiment of FIG. 3, the upper housing 60 has a substantially cuboidal shape with a receiving opening, and is connected to the first terminal housing 40 to cover an upper receiving opening of the first terminal housing 40, to which the female type terminals 10 are attached.

As shown in FIG. 3, the upper housing 60 has a top plate 61, a pair of side walls 62 (62A, 62B) extending downward from the periphery of the top plate 61, and an assembly receiving space 63 defined by the top plate 61 and the side walls 62.

When the upper housing 60 is attached to the electrical connector 1, a mating end of the side wall 62A contacts and pushes the positioning protrusion 18 of the first female terminals 11 downward. In this manner, the first female terminals 11 are fixed to the first terminal housing 40 collectively, with the positioning protrusion 18 being sandwiched between an receiving end of the side walls 45 of the first terminal housing 40, and the mating end of side wall 62A of the upper housing 60.

In this manner, a female housing assembly 5, including the first terminal housing 40, the upper housing 60, the female type terminals 10, and the second terminal housings 50 (see FIG. 2), is mated with the shell 30. Since the shell 30 is fixed to the surface of the circuit board 6, the first female terminals 11 are fixed to the circuit board 6 by through of the first terminal housing 40 and the shell 30.

In an embodiment of FIG. 3, a clearance C is formed between the mating end of the side wall 62B and the receiving ends of the side walls 52 of the second terminal housings 50 in a state in which the upper housing 60 is attached. Accordingly, the second terminal housings 50 holding the second female terminals 12 are not mechanically restricted by the upper housing 60.

While the coupling springs 20 are positioned in the assembly receiving space 63, the top plate 61 and the side walls 62 are positioned around the coupling springs 20 at a distance therefrom, such that portions of the coupling springs 20 are not mechanically restricted. Accordingly, the second female terminals 12, together with the second terminal housings 50, are suspended through the coupling springs 20.

Assembly of the electrical connector 1 will now be described.

The female type terminals 10 and the second terminal housings 50 connected to the second female terminals 12 are housed in the first terminal housing 40, and the upper housing 60 is positioned cover the receiving end opening of first terminal housing 40. The female housing assembly is then positioned in the assembly receiving space 36 of the shell 30, and the female housing assembly 5 and the shell 30 are thereby mated.

Locking of the shell 30 and the first terminal housing 40 is performed by engaging a locking groove 37 of the shell 30 and a corresponding locking protrusion 43 of the first terminal housing 40 (see FIGS. 2 and 3). Locking of the first terminal housing 40 and the upper housing 60 is performed by engaging a locking protrusion 49 of the first terminal housing 40 and a corresponding locking groove 65 of the upper housing 60 (see FIG. 2). While the female type terminals 10 are fixed to the first terminal housing 40 through the first female terminals 11, the second female terminals 12, including the second terminal housings 50, are not fixed to the first terminal housing 40 or other members.

For mating the first male type terminals 3 with the first female terminals 11, the female housing assembly 5, including the first female terminals 11, is inserted into the shell 30 to which the first male type terminals 3 are mechanically restricted. Conversely, upon mating the second male type terminals 4 with the second female terminals 12, the second female terminals 12 are not mechanically restricted. Accordingly, the second female terminals 12 can displace until the clearance C disappears. When there is no clearance, the mating end of the side wall 62B of the upper housing 60 and the receiving end of the second terminal housing 50 will abut. It is accordingly possible to prevent escape of the second female terminals 12 upon mating the second male type terminals 4 to the second female terminals 12. With this arrangement, it is possible to mate the second male type terminals 4 with the second female terminals 12 with no difficulty. In this respect, the clearance C is a region which is elastically deformed by the coupling springs 20.

In the electrical connector 1, while the first female terminals 11 are fixed to the female housing assembly 5 through the first terminal housing 40, the second female terminals 12 are not fixed but merely coupled to the first female terminals 11 through the coupling springs 20. Accordingly, when the first female terminals 11 are displaced, together with the female housing assembly 5, when subjected to vibration, the second female terminals 12 do not necessarily displace following the vibration of the female housing assembly 5. In an embodiment, however, since the inserting and extracting force F2 of the second female terminals 12 and the second male type terminals 4 exceed the load F1 required for the coupling springs 20 to elastically deform, the second female terminals 12 and the second male type terminals 4 can displace while maintaining their connecting positions. In this manner, the first female terminals 11 and the second female terminals 12 can displace independently. Therefore, even when the vibrational modes of the circuit board 6, to which the first female terminals 11 are fixed, and the electronic device (illustration omitted), to which the second female terminals 12 are fixed, differ, they can vibrate in sync with the respective vibration modes of the circuit board 6 and the electronic device while maintaining their connecting positions with respect to the male type terminals. Accordingly, the electrical connector 1 can maintain electric connection between the male type terminals and the female type terminals in a stable manner, even upon connection with male type terminals that are fixed to an electronic device or the like having a different vibration mode.

Since the second male type terminals 4 are mated with the second female terminals 12, the second female terminals 12 vibrate in sync with the second male type terminals 4 upon application of vibrational forces to the second male type terminals 4. While the second male type terminals 4 are positioned through the male terminal receiving openings 55 of the second terminal housings 50, the second terminal housings 50 retain the second female terminals 12 so that the second terminal housings 50 vibrate in sync with the second male type terminals 4.

Accordingly, since the second male type terminals 4 do not slide with respect to the second terminal housings 50 within the male terminal receiving openings 55, it is possible to prevent peeling of the plating film formed on surfaces of the second male type terminals 4. Since the plating film is comprised of a conductive metal, the risk that peeling of the plating film will cause short-circuits of peripheral electronic circuits is prevented.

Assuming the second terminal housings 50 and the first terminal housing 40 are integrally molded, the second male type terminals 4 and the first terminal housing 40 (portion corresponding to the second terminal housings 50) vibrate based on different vibration sources so that phase shifts of vibration are caused in both members. Accordingly, the second male type terminals 4 will slide with respect to the first terminal housing 40 (portion corresponding to the second terminal housings 50) within the male terminal receiving openings 55 so that the risk of peeling of the plating film on the surfaces is reduced.

While the present invention has been described so far based on various embodiments thereof, the present invention is not limited to the above-described embodiments.

While embodiments have illustrated examples in which individual second terminal housings 50 correspond to each second female terminal 12, it is also possible to integrally form the plurality of second terminal housings 50.

The form of the coupling spring 20 is only one example, and it is also possible to employ other shapes and dimensions as long as the above-described effects can be obtained. For example, the connecting beam 23 might also be linear or Z-shaped, instead of S-shaped.

While the first female terminals 11 and the second female terminals 12 are manufactured to be of substantially identical specifications in the present embodiment, the use of two female terminals of different specifications may also be used. Further, while the first female terminals 11 and the second female terminals 12 are inserted with the male type terminals respectively from the same direction, and are positioned in parallel, such embodiments are merely exemplary, and there are no restrictions for positioning the two female terminals and of directions from which the male type terminals are inserted.

Moreover, while examples of box-type female type terminals and tab-type male type terminals have been described, one of ordinary skill in the art would appreciated that the present invention extends to female type terminals and male type terminals of different types.

In addition to the above, the configurations listed in the above embodiment can be variously chosen or suitably changed to other configurations as long as such variations do not depart from the spirit of the present invention.

What is claimed is:

1. An electrical connector, comprising:

a terminal housing having a first terminal housing, and a second terminal housing positioned independent from the first terminal housing;

a female type terminal positioned in the terminal housing, and having a first female terminal positioned in the first terminal housing and being electrically connected to a first male terminal, a second female terminal positioned in the second terminal housing and being electrically connected to a second male terminal, and a coupling member connecting the first female terminal to the second female terminal; and a shell having an assembly receiving space, the first terminal housing and the second terminal housing disposed in the assembly receiving space.

2. The electrical connector according to claim 1, further comprising a plurality of the female type terminals positioned in a row in the terminal housing.

3. The electrical connector according to claim 2, further comprising a plurality of the first female terminals.

4. The electrical connector according to claim 3, further comprising a plurality of the second female terminals.

5. The electrical connector according to claim 4, wherein an integrally molded first terminal housing holds the plurality of first female terminals collectively.

6. The electrical connector according to claim 5, wherein a plurality of individually molded second terminal housings hold the plurality of second female terminals.

7. The electrical connector according to claim 1, wherein the first terminal housing has first terminal receiving space into which the first female terminal is positioned.

8. The electrical connector according to claim 7, wherein the first terminal housing further includes a second terminal housing receiving space positioned adjacent to the first terminal receiving space and into which the second terminal housing is positioned.

9. The electrical connector according to claim 8, wherein the second terminal housing holds the second female terminal in the second terminal housing receiving space of the first terminal housing.

10. The electrical connector according to claim 1, wherein the first male terminal and the second male terminal are disposed along the same direction in the interior of the housing.

11. The electrical connector according to claim 10, wherein the first male terminal and the second male terminal are independently displaceable with respect to each other.

12. The electrical connector according to claim 10, wherein the first male terminal and the second male terminal have independent vibrational modes.

13. The electrical connector according to claim 1, wherein the first terminal housing is connected to the shell.

14. The electrical connector according to claim 9, further comprising an upper housing having a receiving opening.

15. The electrical connector according to claim 14, wherein the upper housing is connected to the first terminal housing.

16. The electrical connector according to claim 15, wherein the upper housing covers the first terminal receiving space and the second terminal housing receiving space.

* * * * *